US008756729B2

(12) United States Patent
Clark et al.

(10) Patent No.: US 8,756,729 B2
(45) Date of Patent: Jun. 24, 2014

(54) HAMMOCK-RIDGE-CONNECTION SYSTEM

(75) Inventors: Gary L. Clark, Salt Lake City, UT (US); Spencer D. Clark, Salt Lake City, UT (US)

(73) Assignee: Clark Outdoor Products, L.C., Salt Lake City, UT (US)

( * ) Notice: Subject to any disclaimer, the term of this patent is extended or adjusted under 35 U.S.C. 154(b) by 150 days.

(21) Appl. No.: 13/181,304

(22) Filed: Jul. 12, 2011

(65) Prior Publication Data

US 2012/0005827 A1 Jan. 12, 2012

Related U.S. Application Data

(60) Provisional application No. 61/363,640, filed on Jul. 12, 2010.

(51) Int. Cl.
*A45F 4/08* (2006.01)

(52) U.S. Cl.
USPC ..... 5/121; 5/120

(58) Field of Classification Search
USPC ..... 5/120–123, 127–130
See application file for complete search history.

(56) References Cited

U.S. PATENT DOCUMENTS

| | | | | | |
|---|---|---|---|---|---|
| 273,388 | A | | 3/1883 | Pratt | |
| 329,763 | A | | 11/1885 | Nelmes et al. | |
| 363,713 | A | * | 5/1887 | Wirgman | 135/143 |
| 495,366 | A | | 4/1893 | Perry | |
| 507,426 | A | * | 10/1893 | French | 5/127 |
| 638,174 | A | * | 11/1899 | Diggins | 5/128 |
| 818,882 | A | * | 4/1906 | Graeme | 5/121 |
| 866,322 | A | * | 9/1907 | Barratt | 5/98.3 |
| 955,281 | A | | 4/1910 | Norwood | |
| 961,704 | A | * | 6/1910 | Mark | 5/121 |
| RE13,401 | E | * | 4/1912 | Palmer | 5/98.1 |
| 1,401,846 | A | | 12/1921 | Wiles | |
| 2,375,792 | A | | 5/1945 | Kearny | |
| 4,001,902 | A | * | 1/1977 | Hall et al. | 5/121 |
| 4,057,859 | A | | 11/1977 | Stetterholm | |
| 4,071,917 | A | * | 2/1978 | Mojica | 5/121 |
| 4,308,883 | A | * | 1/1982 | Malone | 135/90 |
| 4,320,542 | A | | 3/1982 | Cohen | |
| 4,499,133 | A | * | 2/1985 | Prince | 428/81 |
| 5,579,548 | A | * | 12/1996 | Death | 5/127 |
| 5,913,772 | A | * | 6/1999 | Clark | 5/121 |
| 6,347,638 | B1 | | 2/2002 | Scott et al. | |
| 6,353,946 | B1 | | 3/2002 | Steiner | |
| 6,389,620 | B1 | * | 5/2002 | Hennessy | 5/120 |
| 6,421,851 | B2 | | 7/2002 | Hennessy | |

(Continued)

*Primary Examiner* — William Kelleher
*Assistant Examiner* — Myles Throop
(74) *Attorney, Agent, or Firm* — Warren M. Pate; Pate Peterson, PLLC

(57) ABSTRACT

A hammock is disclosed. The hammock may include a bed portion having first and second ends spaced a distance from one another. The first end of the bed portion may be suspended from a first tether. The second end of the bed portion may be suspended from a second tether. The hammock may further include an upper portion comprising netting. The upper portion may cooperate with the bed portion to form an enclosure for housing an occupant. The hammock may also include a ridge line extending from the first tether, through the upper portion, to the second tether. The ridge line may have a length greater than the distance between the first and second ends of the bed portion. Accordingly, the upper portion may be suspended some distance above the bed portion, creating greater space for the occupant within the enclosure.

20 Claims, 9 Drawing Sheets

(56) References Cited

U.S. PATENT DOCUMENTS

| | | | | |
|---|---|---|---|---|
| 7,383,597 | B2 | 6/2008 | Steiner | |
| 7,627,913 | B2 | 12/2009 | Clark | |
| 7,699,068 | B2 * | 4/2010 | Helsdon | 135/90 |
| D666,896 | S * | 9/2012 | Pinholster et al. | D8/356 |
| 8,356,370 | B1 | 1/2013 | Clark | |
| 8,650,679 | B1 * | 2/2014 | Clark et al. | 5/123 |
| 2005/0177938 | A1 * | 8/2005 | Steiner | 5/121 |
| 2005/0188460 | A1 | 9/2005 | O'Brien | |
| 2007/0289667 | A1 | 12/2007 | Hennessy | |
| 2008/0072944 | A1 * | 3/2008 | Wu | 135/90 |
| 2008/0236642 | A1 * | 10/2008 | Helsdon | 135/90 |
| 2009/0165205 | A1 | 7/2009 | Hennessy | |

* cited by examiner

HAMMOCK-RIDGE-CONNECTION SYSTEM

RELATED APPLICATIONS

This application claims the benefit of U.S. Provisional Patent Application Ser. No. 61/363,640 filed Jul. 12, 2010, which is hereby incorporated by reference.

BACKGROUND

1. The Field of the Invention

This invention relates to hammocks and, more particularly, to novel systems and methods facilitating correct set up of a hammock.

2. The Background Art

When setting up a hammock as disclosed in U.S. Pat. No. 5,913,772 (which is hereby incorporated by reference) it may be difficult for a new user to properly gauge the amount of slack necessary for optimal comfort and proper function. Too little slack may make the hammock difficult to enter. It may also unnecessarily stress certain components of the hammock or associated rain fly. Too much slack may produce an uncomfortable sleeping position, insufficient water drainage, and the like. Accordingly, what is needed is a hammock providing simplified set up.

BRIEF SUMMARY OF THE INVENTION

In view of the foregoing, in accordance with the invention as embodied and broadly described herein, a method and apparatus are disclosed in one embodiment of the present invention as including a hammock comprising a bed portion and an upper portion. A first tether may suspend a first end of the bed portion from a first anchor (e.g., first tree). A second tether may suspend a second end of the bed portion from a second anchor (e.g., second tree). A first connection system may engage the first tether and extend therefrom to engage one end of the upper portion. A second connection system may engage the second tether and extend therefrom to engage an opposite end of the upper portion. Accordingly, the first and second connection systems may suspend the upper portion above the bed portion, providing a user with greater space within the interior of the enclosure.

When the hammock is properly set up (i.e., suspended between two trees with a proper amount of slack), the first and second connection systems may form a substantially level and straight ridge line in the upper portion. That is, as the distance between one or both of the first and second ends and the corresponding trees decreases, the slack in the hammock may transition from excessive, to about right, to insufficient. As the hammock reaches just about the right amount of slack, the first and second connection systems may cooperate to form within the upper portion a substantially straight and level ridge line. If the ridge formed in the upper portion sags, the user may know that the hammock has too much slack. Conversely, if the hammock has been tightened well past the point where the sag in the ridge line has been consumed, the user may know that the hammock has too little slack.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
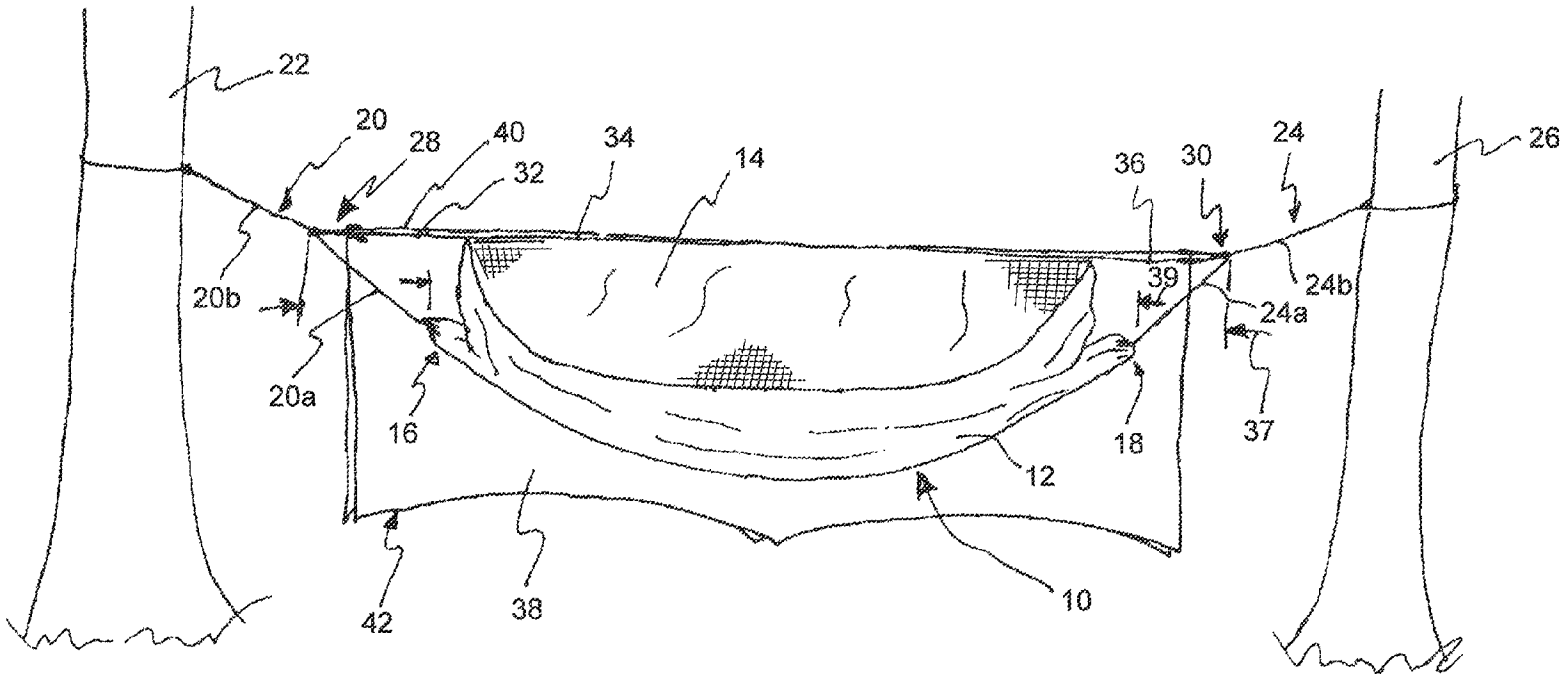
FIG. 1 is a side elevation view of a hammock and fly in accordance with the present invention suspended between two anchors.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Figure 2:
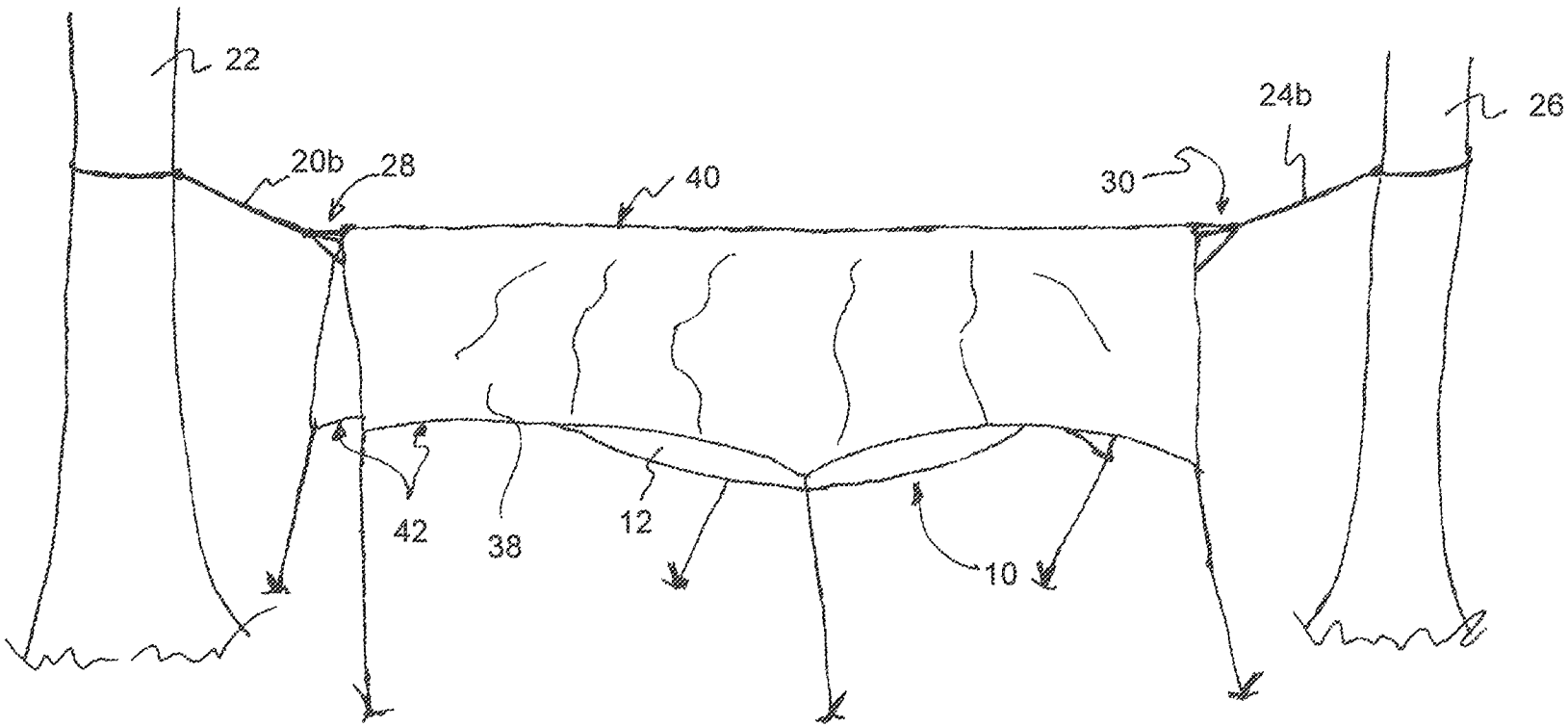
FIG. 2 is a side elevation view of the hammock and fly of FIG. 1 with the fly in a deployed configuration.

Referring to FIGS. 1 and 2, a hammock 10 in accordance with the present invention may include a base or bed portion 12, an upper portion 14 (e.g., netting portion 14), a first end 16, a second end 18 spaced longitudinally from the first end 16, a first tether 20 suspending the first end 16 from a first anchor 22, and a second tether 24 suspending the second end 18 from a second anchor 26.

A hammock 10 may further include first and second ridge connection systems 28, 30 (i.e., first and second connections systems 28, 30). A first connection system 28 may engage the first tether 20 and extend therefrom to engage one end of a ridge portion 34 (i.e., an upper most portion of an upper portion 14) of a hammock 10. In selected embodiments, a first connection system 28 may include a third tether 32 extending between the ridge portion 34 and the rest of the first connection system 28. A second connection system 30 may engage the second tether 24 and extend therefrom to engage an opposite end of the ridge portion 34 of the hammock 10. If desired, a second connection system 30 may include a fourth tether 36 extending between the ridge portion 34 and the rest of the second connection system 30.

First and second connection systems 28, 30 may support or suspend the upper portion 14 of a hammock 10 above and spaced from the base portion 12 of the hammock 10. Accordingly, the first and second connection systems 28, 30 may provide a user with greater space within the interior of the hammock 10.

In selected embodiments, a first connection system 28 may define a boundary between an inboard portion 20*a* of the first tether 20 and the outboard portion 20*b* of the first tether 20. Similarly, a second connection system 30 may define a boundary between an inboard portion 24*a* of the second tether 24 and the outboard portion 24*b* of the second tether 24.

In selected embodiments, the first and second connection systems 28, 30 and the ridge portion 34 may combine to form a ridge extending in the longitudinal direction. The length 37 of this ridge may be longer than the length 39 of the base portion 12 when the base portion 12 hangs with a desired amount of sag. The length 37 may also be longer than the length of the base portion 12 when the first and second ends 16, 18 are pulled apart to their maximum separation (e.g., longer than the sheet of material forming the base portion 12).

In certain embodiments, when the hammock 10 is properly set up (i.e., suspended between anchors 22, 26 with a proper amount of slack), the first and second connection systems 28, 30 may cooperate to suspend the ridge portion 34 of the hammock 10 without significant sag in a substantially level position. During set up, the first and second connection systems 28, 30 and the ridge portion 34 may collectively form a gauge indicative of proper set up.

That is, as the distance between one or both of the first and second ends 16, 18 and the corresponding anchors 22, 26 decreases, the slack in the hammock 10 may transition from excessive, to about right, to insufficient. As the hammock 10 reaches just about the right amount of slack, the first and second connection systems 28, 30 may cooperate to pull the ridge portion 34 of the hammock 10 into a substantially straight and level line.

Accordingly, in such embodiments, if the ridge portion 34 sags, the user may know that the hammock 10 has too much slack. Conversely, if the hammock 10 has been tightened well past the point where the sag in the ridge portion 34 was consumed, the user may know that the hammock 10 has too little slack. The first point at which all significant sag has been removed from the ridge portion 34, and the ridge portion 34 is substantially level, may correspond to a proper set up of the hammock 10.

In selected embodiments, a hammock 10 in accordance with the present invention may include, or be coupled with, a rain fly 38. When deployed as shown in FIG. 2, a fly 38 may extend to protect a hammock 10 and its occupant from precipitation, wind, or the like. When connected to a hammock 10, a fly 38 may be suspended from and between the first and second connection systems 28, 30. For example, a fly 38 may be symmetric across a ridge portion 40 or center line 40 of the fly 38. One end of the ridge portion 40 of the fly 38 may be connected to the first connection system 28. The other end of the ridge portion 40 of the fly 38 may be connected to the second connection system 30.

When a fly 38 is connected, but not fully deployed, it may hang along one side of a hammock 10 in the manner illustrated in FIG. 1. Alternatively, a fly 38 that is connected, but not fully deployed, may extend to cover a hammock 10 without being pulled snug and staked. In either such configuration, the first and second connection systems 28, 30 and the fly 38 may collectively form a gauge indicative of proper set up.

As disclosed above, as the distance between one or both of the first and second ends 16, 18 and the corresponding anchors 22, 26 decreases, the slack in the hammock 10 may transition from excessive, to about right, to insufficient. As the hammock 10 reaches just about the right amount of slack, the first and second connection systems 28, 30 may pull the ridge portion 40 of the fly 38 into a substantially straight and level line.

Accordingly, in such embodiments, if the ridge portion 40 of a fly 38 sags, the user may know that the hammock 10 has too much slack. Conversely, if the hammock 10 has been tightened well past the point where the sag in the ridge portion 40 of the fly 38 was consumed, the user may know that the hammock 10 has too little slack. The first point at which all significant sag has been removed from the ridge portion 40 of the fly 38, and the ridge portion 40 is substantially level, may correspond to a proper set up of the hammock 10.

In certain embodiments or installations, the first and second connection systems 28, 30 and the fly 38 may collectively form the primary gauge indicative of proper set up. In other embodiments or installations, the first and second connection systems 28, 30 and the ridge portion 34 may collectively form the primary gauge indicative of proper set up. In still other embodiments or installations, both (a) the first and second connection systems 28, 30 and the fly 38 and (b) the first and second connection systems 28, 30 and the ridge portion 34 may form a useful gauge indicative of proper set up.

A fly 38 in accordance with the present invention may have any suitable shape. In selected embodiments, certain edges 42 of a fly 38 may be scalloped to reduce any buffeting caused by wind impacting the fly 38.

Figure 3:
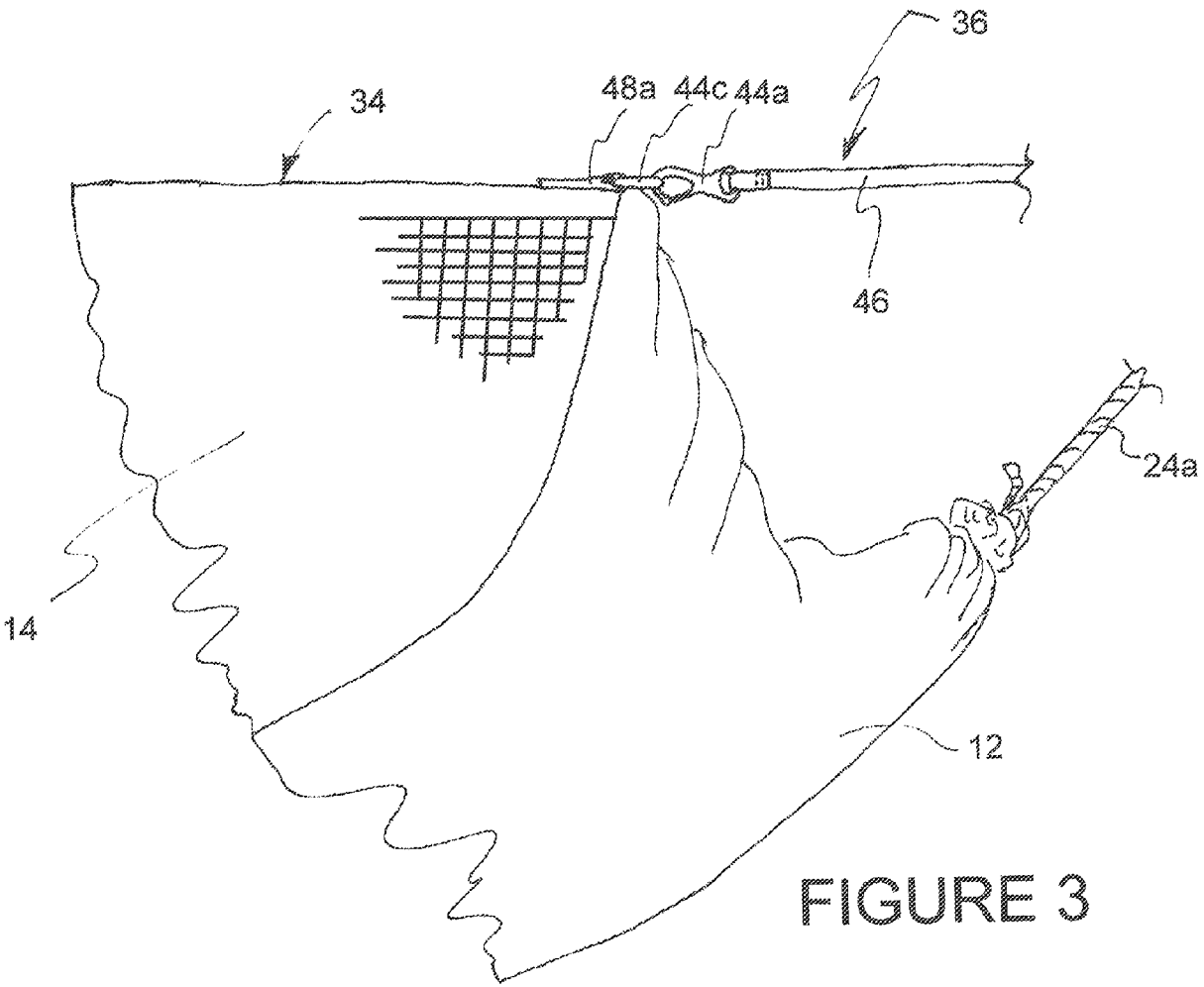
FIG. 3 is a partial side elevation view of one end of the hammock of FIG. 1.
Figure 4:
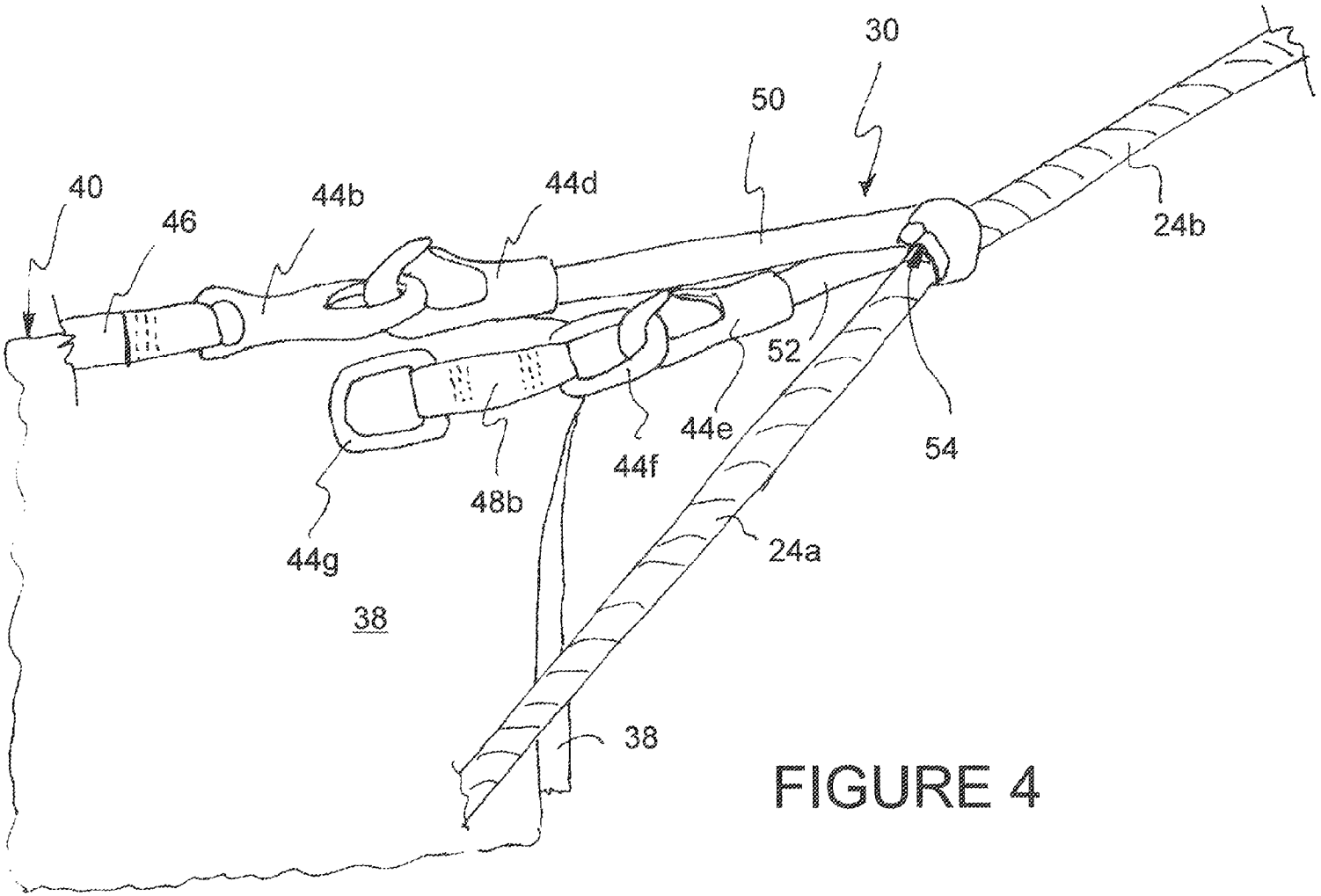
FIG. 4 is a side elevation view of one embodiment of a ridge connection system in accordance with the present invention.

Referring to FIGS. 3 and 4, in selected embodiments, the third and fourth tethers 32, 36 may each include various fasteners 44 facilitating engagement and disengagement thereof. For example, in one embodiment, a third or fourth tether 32, 36 may include a length of strap material 46, a releasable clip 44*a* connected to one end of the strap material 46, and another releasable clip 44*b* connected to the other end of the strap material 46.

An upper portion 14 of a hammock 10 may be configured to support selective engagement with a tether 32, 36. For example, in certain embodiments, each end of the ridge portion 34 of a hammock 10 may include an anchor 48*a* and a securement loop 44*c*. The anchor 48*a* may secure the securement loop 44*c* to the corresponding end of the ridge portion 34 of the hammock 10.

In certain embodiments, the ridge portion 34 of a hammock 10 may be reinforced to properly resolve the loads imposed thereon by opposing anchors (e.g., anchor 48*a* and a corresponding anchor on the opposite end of the ridge portion 34). For example, in one embodiment, the ridge portion 34 of a hammock 10 may comprise a longitudinal seam in the netting material. The seam may result in an increased amount of netting material being present to resolve the longitudinal tensile load applied along the ridge portion 34 of the hammock 10.

The first and second connection systems 28, 30 may each include structures suitable to facilitate respective engagement between the first and second tethers 20, 24 and corresponding ends of the ridge portion 34. Alternatively or in addition thereto, the first and second connection systems 28, 30 may each include structures suitable to facilitate respective engagement between the first and second tethers 20, 24 and opposite ends of the ridge portion 40 of a fly 38.

In selected embodiments, the first and second connection systems 28, 30 may each include first and second extensions 50, 52 and first and second releasable clips 44*d*, 44*e*. While one end of each of the first and second extensions 50, 52 may engage the tether 20, 24 corresponding thereto, the opposite ends of each of the first and second extensions 50, 52 may respectively engage the first and second releasable clips 44*d*, 44*e*.

In one embodiment, the first extension 50 may extend such that the releasable clip 44*d* associated therewith engages the releasable clip 44*b* of a corresponding tether 32, 36. The second extension 52 may extend such that the releasable clip 44*e* associated therewith engages the fly 38. For example, a ridge portion 40 of a fly 38 may be configured to support selective engagement with the first and second connection systems 28, 30. In certain embodiments, each end of the ridge portion 40 of a fly 38 may include an anchor 48*b* and a securement loop 44*f*. Each anchor 48*b* may secure a corresponding securement loop 44*f* to the associated end of the ridge portion 40 of the fly 38. Accordingly, the second extension 52 may extend such that the releasable clip 44*e* associated therewith engages a securement loop 44*f* of the fly 38.

Figure 5:
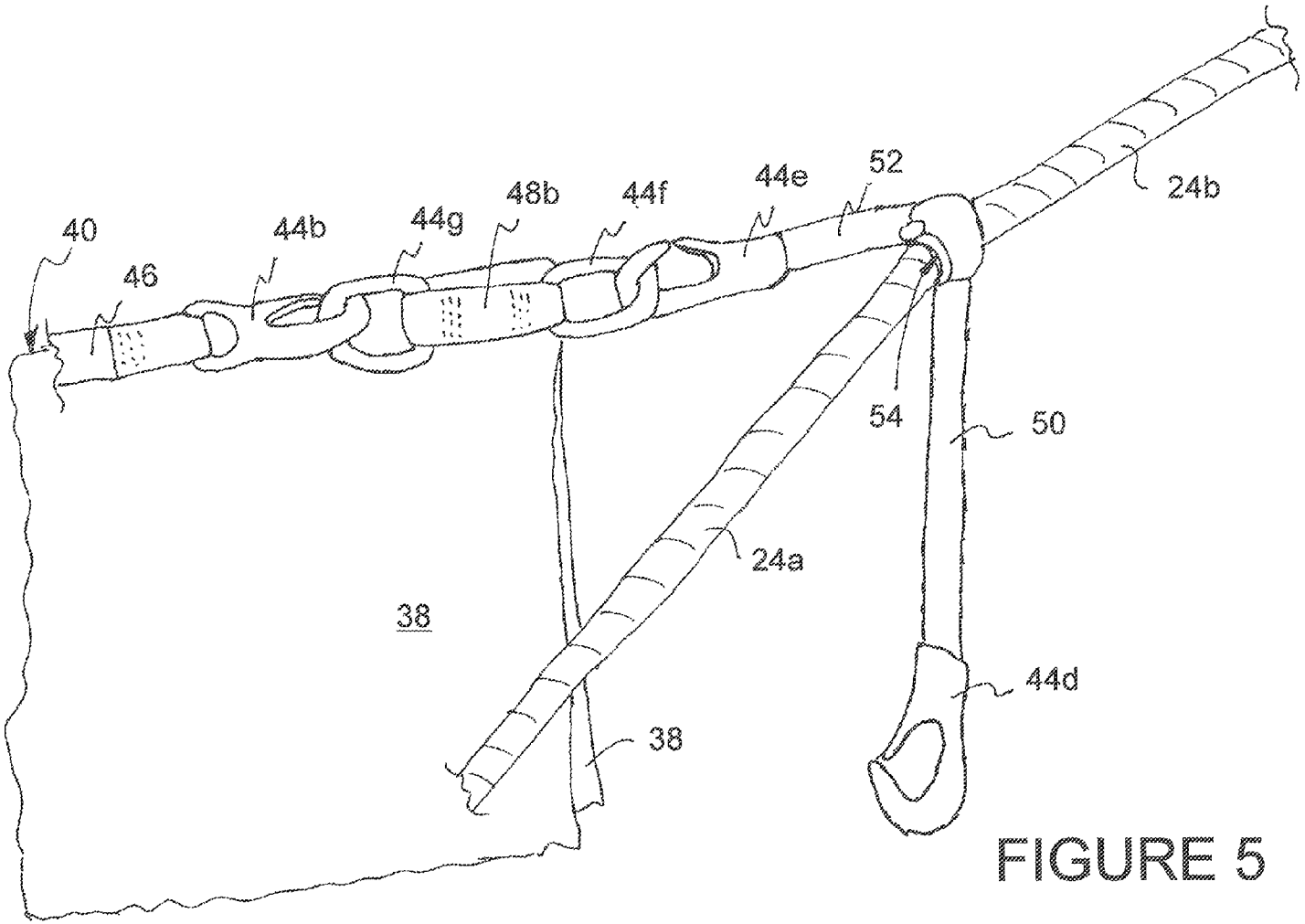
FIG. 5 is a side elevation view of an alternative embodiment of a ridge connection system in accordance with the present invention.

Referring to FIGS. 4 and 5, in selected embodiments, a fly 38 may be connected in series (rather than in parallel) with respect to the upper portion 14 of a hammock 10. For example, in certain embodiments, each anchor 48*b* secured to the ridge portion 40 a fly 38 may secure a second corresponding securement loop 44*g*. Accordingly, rather than engaging the releasable clip 44*d* corresponding to the first extension 50 as shown in FIG. 4, the releasable clip 44*b* of a corresponding tether 32, 36 may engage the second securement loop 44*g* connected to the fly 38 in the manner shown in FIG. 5. In such embodiments, the first extension 50 and corresponding releasable clip 44*d* may be omitted or simply left unutilized.

First and second extensions 50, 52 in accordance with the present invention may be connected to the first and second tethers 20, 24 in any suitable manner. In selected embodiments, the first and second extensions 50, 52 may comprise opposite ends of a elongate member tied or otherwise bound to a corresponding tether 20, 24. In certain embodiments, it may be necessary or desirable to prevent the first and second extensions 50, 52 from moving with respect to (e.g., sliding along) a corresponding tether 20, 24. Accordingly, in selected embodiments, first and second connection systems 28, 30 may include stops 54 resisting such motion.

A stop 54 may have any suitable configuration. For example, in selected embodiments, a stop 54 may comprise a knot formed in the tether 20, 24. Alternatively, a stop 54 may comprise metal crimped to firmly engage the tether 20, 24. In still other embodiments, a stop 54 may comprise a cable tie tightened onto the tether 20, 24.

First and second extensions 50, 52 in accordance with the present invention may be formed of any suitable material. In selected embodiments, the first and second extensions 50, 52 may be formed of a material (or combination of materials) exhibiting significant elasticity. This elasticity may support flexibility and adaptation without damage as a hammock 10 and fly 38 in accordance with the present invention are set up and used.

Figure 6:
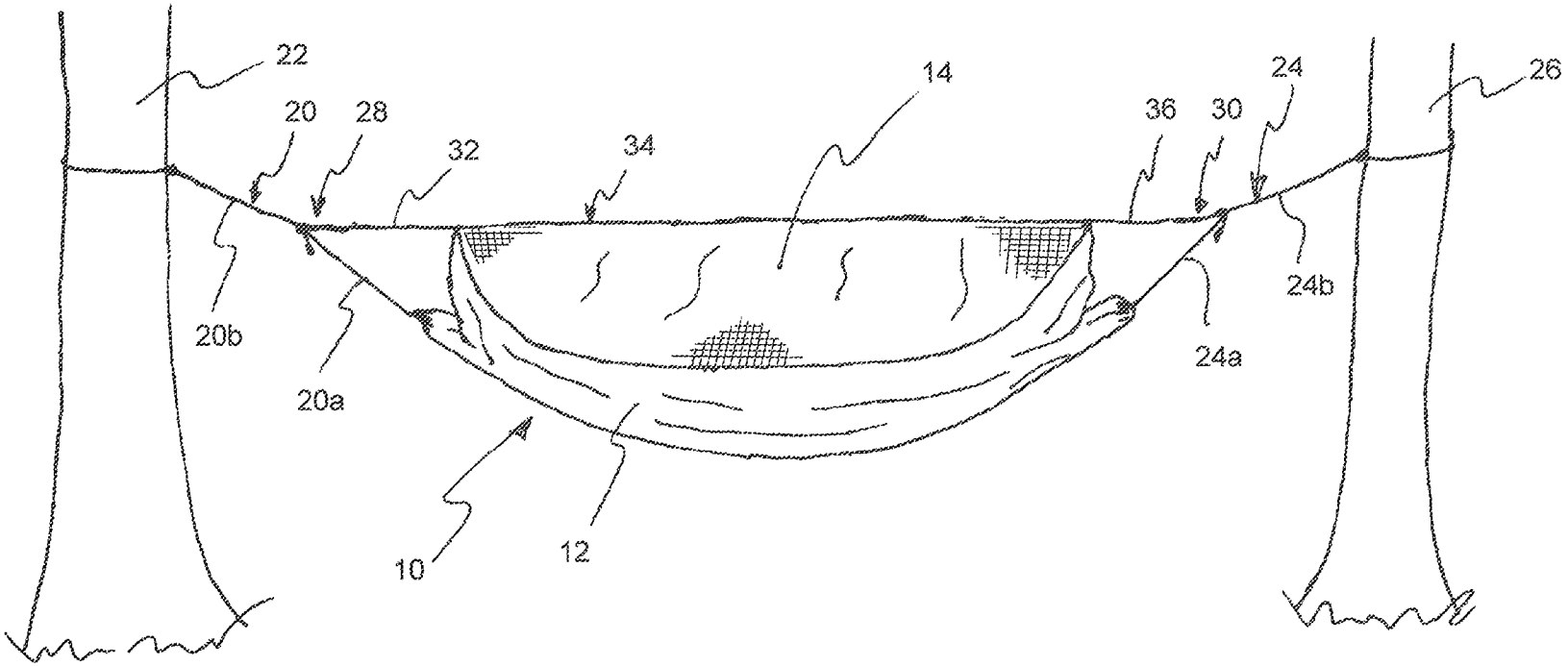
FIG. 6 is a side elevation view of the hammock of FIG. 1 in accordance with the present invention suspended between two anchors.
Figure 7:
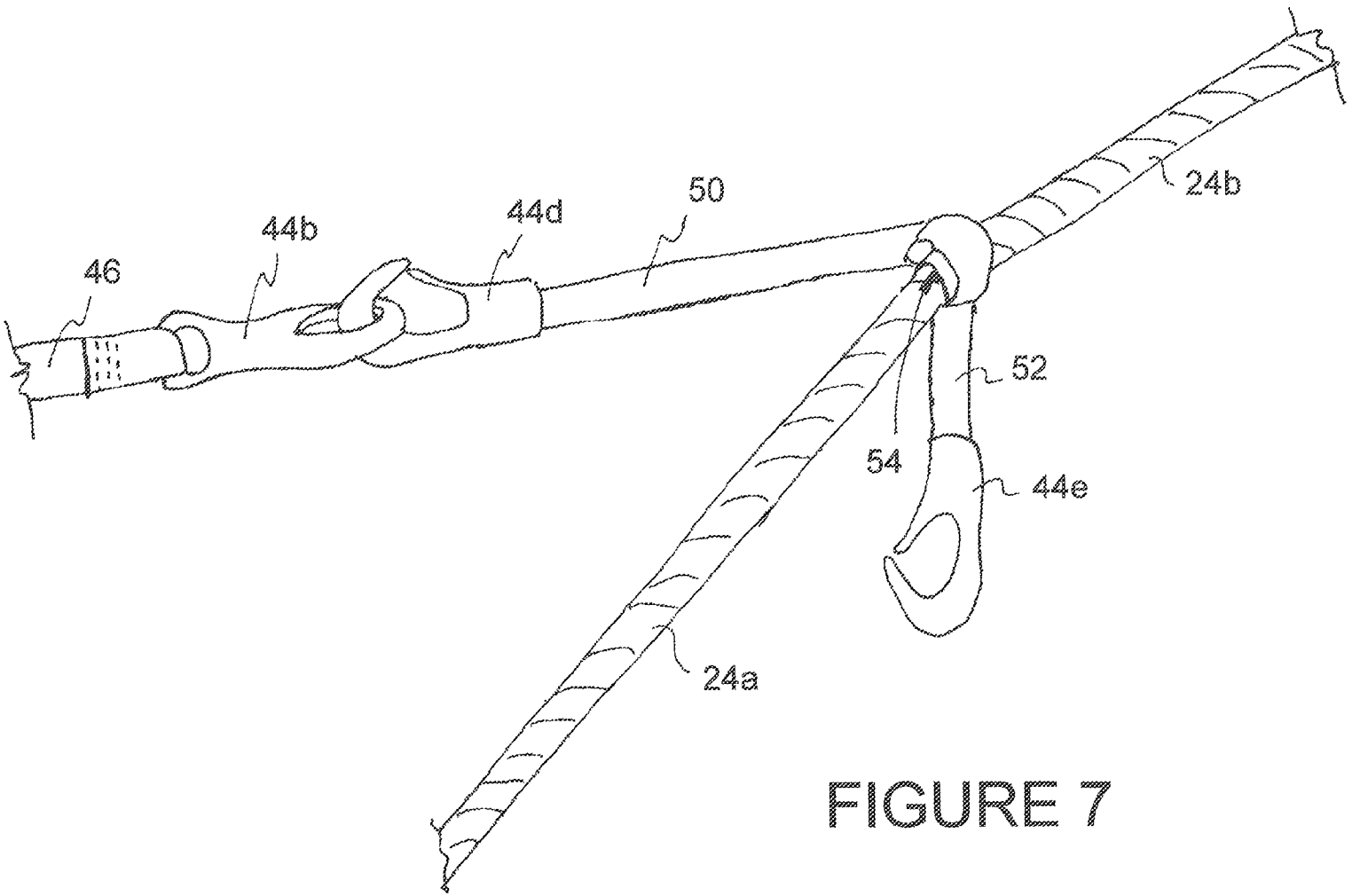
FIG. 7 is a side elevation view of another alternative embodiment of a ridge connection system in accordance with the present invention.

Referring to FIGS. 6 and 7, in certain applications, it may be desirable to set up the hammock 10 without the rain fly 38. In such applications, the second extensions 52 and corresponding releasable clips 44*e* may be disconnected from the fly 38. Accordingly, the first extension 50 and corresponding releasable clip 44*d* may continue to support or suspend the upper portion 14 of hammock 10, while the second extension and corresponding releasable clip 44*e* may be left unutilized, removed, or omitted.

Figure 8:
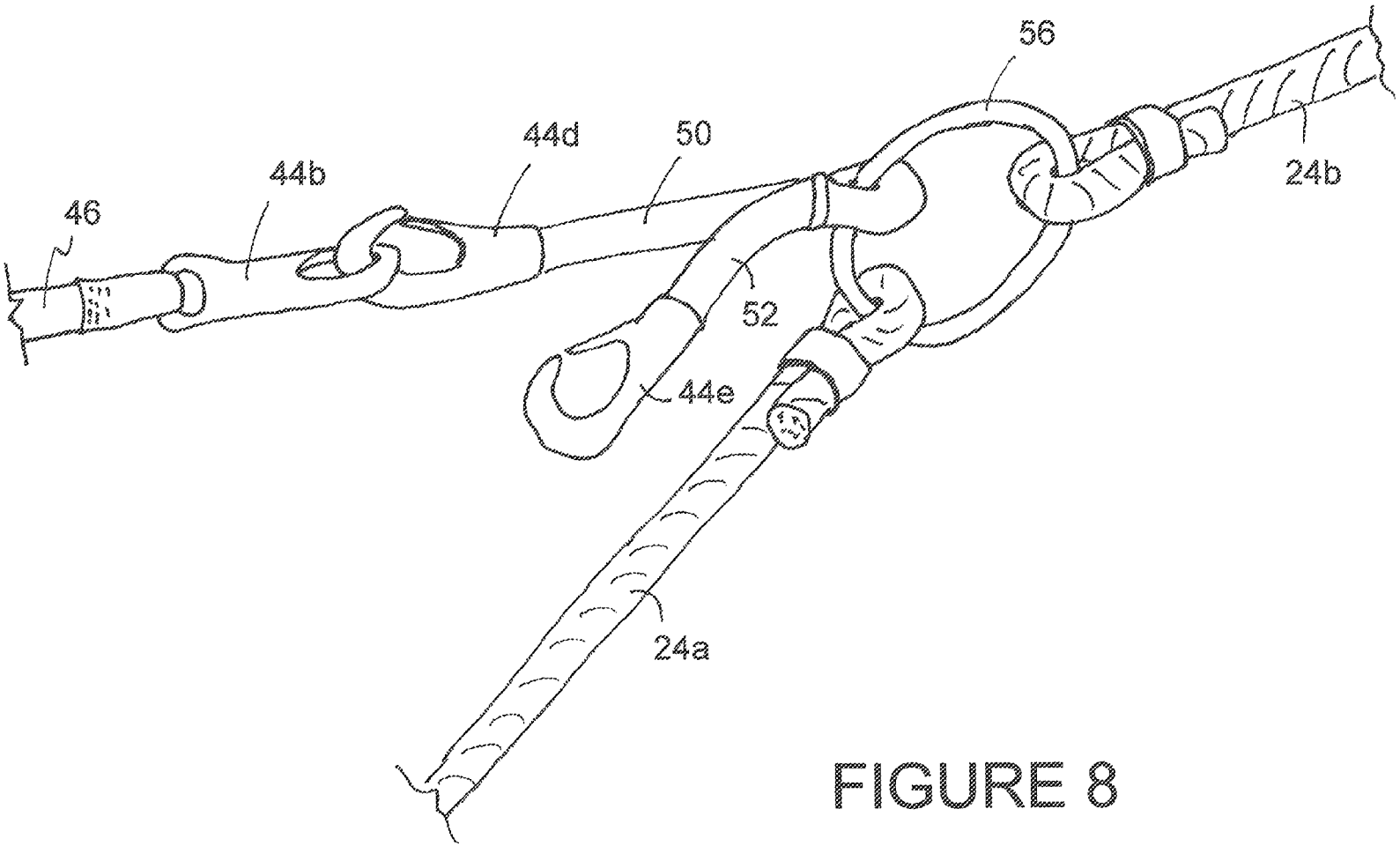
FIG. 8 is a side elevation view of another alternative embodiment of a ridge connection system in accordance with the present invention.
Figure 9:
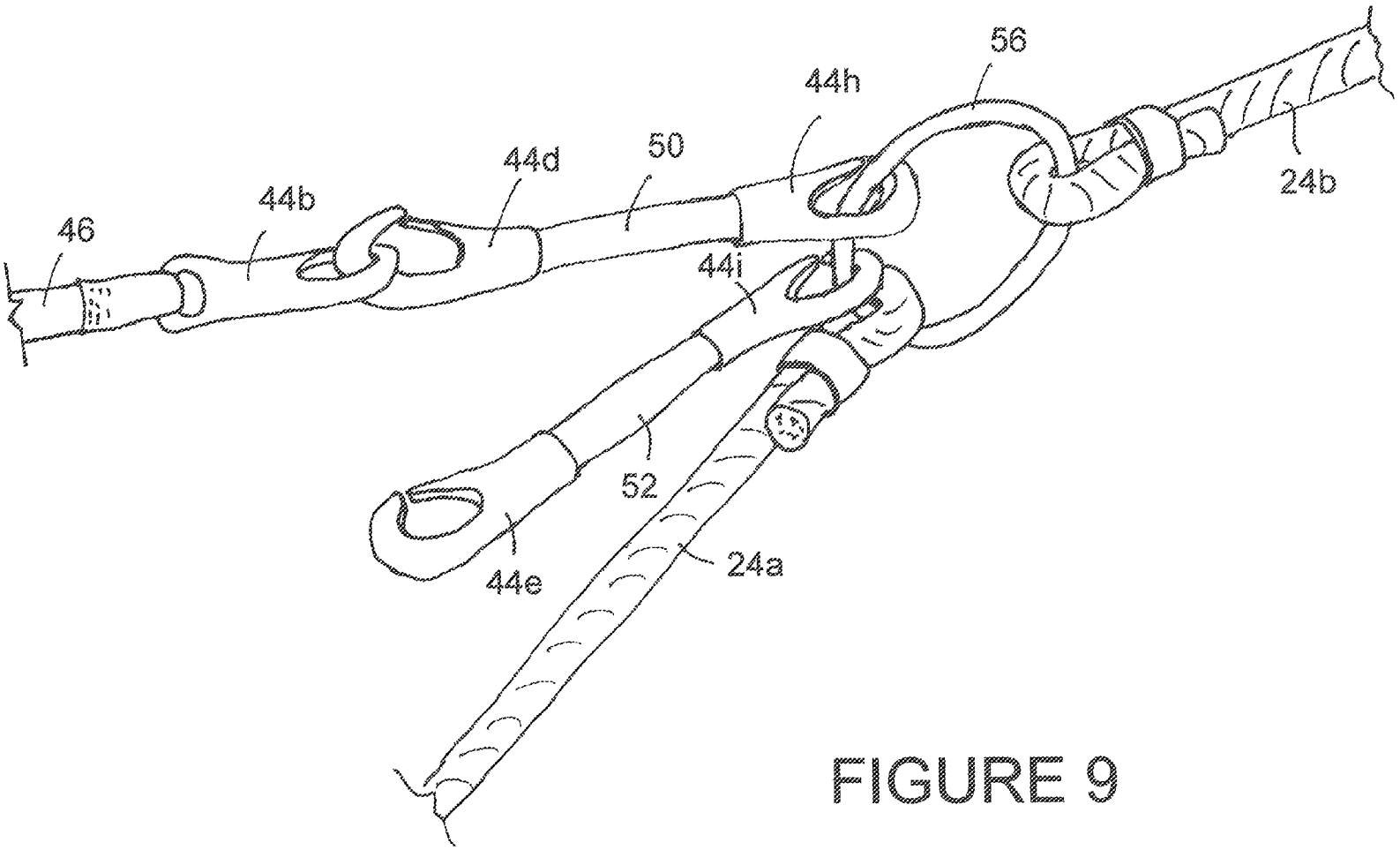
FIG. 9 is a side elevation view of another alternative embodiment of a ridge connection system in accordance with the present invention.

Referring to FIGS. 8 and 9, in selected embodiments, a ring 56 (e.g., metal loop, carabiner, or the like) may interface between the inboard portions 20*a*, 24*a* and outboard portions 20*b*, 24*b* of a tether 20, 24. A ring 56 may provide a structure to which one or more components of a first or second connection system 28, 30 may secure. For example, a ring 56 may provide a structure for securing a first extension 50, a second extension 52, or both.

A first extension 50, a second extension 52, or combination thereof may secure to a ring 56 in any suitable manner. In selected embodiments, the first and second extensions 50, 52 may comprise opposite ends of a elongate member tied, looped through, or otherwise bound to a corresponding ring 56. In other embodiments, the first and second extensions 50, 52 may be separable components, each engaging a ring 56 with a different fastener 44*h*, 44*i*, respectively. In such embodiments, one extension 50, 52 may be removed from a ring 56 without affecting the function or connection of the other 52, 50.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A hammock system comprising:

first and second tethers;

a bed portion;

an upper portion comprising netting and cooperating with the bed portion to form an enclosure, the enclosure having opposing first and second ends that respectively extend to and are suspended by the first and second tethers;

a first connection system directly connecting the upper portion to the first tether;

a second connection system directly connecting the upper portion to the second tether; and the first and second connection systems cooperating to suspend netting of the upper portion higher than the first and second ends.

2. The hammock system of claim 1, further comprising a ridge line extending from the first tether to the second tether, the ridge line extending along and through the first connection system, the netting of the upper portion, and the second connection system.

3. The hammock system of claim 2, further comprising a rain fly extending over the upper portion and the bed portion.

4. The hammock system of claim 3, wherein the rain fly comprises a center line having a first end and a second end opposite the first end.

5. The hammock system of claim 4, wherein:

the first connection system connects the first end of the center line to the first tether; and the second connection system connects the second end of the center line to the second tether.

6. The hammock system of claim 5, wherein the center line of the rain fly directly overlays at least a portion of the ridge line.

7. The hammock system of claim 6, further comprising first and second anchors respectively suspending the first and second tethers.

8. The hammock system of claim 1, wherein the first connection system connects to the first tether at a location on the first tether that is spaced from both the first end and the first anchor.

9. The hammock system of claim 8, wherein the second connection system connects to the second tether at a location on the second tether that is spaced from both the second end and the second anchor.

10. The hammock system of claim 9, wherein the ridge line extends above the first and second ends.

11. A hammock system comprising:

first and second tethers;

a bed portion;

an upper portion comprising netting and cooperating with the bed portion to form an enclosure, the enclosure having opposing first and second ends spaced from one another along a longitudinal axis, the first end extending to and suspending from the first tether, the second end extending to and suspending from the second tether;

a first connection system extending to connect the upper portion to the first tether;

a second connection system extending to connect the upper portion to the second tether; and the first and second connection systems forming in the netting of the upper portion a ridge spaced from and positioned above the longitudinal axis and the first and second ends positioned along the longitudinal axis.

12. The hammock system of claim 11, wherein the ridge is substantially parallel to the longitudinal axis.

13. The hammock system of claim 11, further comprising a rain fly extending over the upper portion and the bed portion.

14. The hammock system of claim 13, wherein the rain fly comprises a center line having a first end and a second end opposite the first end.

15. The hammock system of claim 14, wherein:

the first connection system connects the first end of the center line to the first tether; and the second connection system connects the second end of the center line to the second tether.

16. The hammock system of claim 15, wherein the first and second connection systems form in the rain fly a ridge positioned above the longitudinal axis.

17. The hammock system of claim 16, wherein the ridge of the rain fly is positioned directly above the ridge of the upper portion.

18. The hammock system of claim 11, further comprising first and second anchors respectively suspending the first and second tethers.

19. The hammock system of claim 18, wherein:

the first connection system connects to the first tether at a location on the first tether that is space from both the first end of the bed portion and the first anchor; and the second connection system connects to the second tether at a location on the second tether that is spaced from both the second end of the bed portion and the second anchor.

20. A hammock system comprising:

first and second anchors;

first and second tethers respectively suspended from the first and second anchors;

a bed portion;

an upper portion comprising netting and cooperating with the bed portion to form an enclosure, the enclosure having first and second ends spaced from one another and a length extending from the first end to the second end, the first end extending to and suspending from the first tether, the second end extending to and suspending from the second tether;

a first connection system extending to connect the upper portion to the first tether at a location on the first tether that is spaced from both the first end of the enclosure and the first anchor;

a second connection system extending to connect the upper portion to the second tether at a location on the second tether that is spaced from both the second end of the enclosure and the second anchor; and the first and second connection systems cooperating to suspend netting of the upper portion higher than the first and second ends of the enclosure.

* * * * *